US007762035B2

(12) United States Patent
Cappelle

(10) Patent No.: US 7,762,035 B2
(45) Date of Patent: Jul. 27, 2010

(54) FLOOR PANEL AND FLOOR COVERING COMPOSED OF SUCH FLOOR PANELS

(75) Inventor: Mark Cappelle, Staden (BE)

(73) Assignee: Flooring Industries Limited, SARL, Bertrange (LU)

( * ) Notice: Subject to any disclaimer, the term of this patent is extended or adjusted under 35 U.S.C. 154(b) by 386 days.

(21) Appl. No.: 11/231,966

(22) Filed: Sep. 22, 2005

(65) Prior Publication Data

US 2006/0064940 A1 Mar. 30, 2006

(30) Foreign Application Priority Data

Sep. 24, 2004 (BE) ..... 2004/0476

(51) Int. Cl.
*E04B 2/00* (2006.01)

(52) U.S. Cl. ..... 52/588.1; 52/390; 52/539; 52/592.2; 428/50

(58) Field of Classification Search ..... 52/396.04, 52/582.1, 586.2, 403.1, 589.1, 588.1, 390, 52/392, 533, 534, 539, 553, 578, 586.1, 590.2, 52/590.3, 591.1, 591.2, 591.3, 591.4, 591.5, 52/592.1, 582.2, 582.4, 745.08, 745.19, 747.1, 52/747.11, 748.1, 748.11; 428/44, 47–50, 428/57, 58, 60, 61, 106, 192–194; 403/334, 403/345, 364–368, 372, 375, 376, 381; 404/34, 404/35, 40, 41, 46, 47, 49–58, 68, 70
See application file for complete search history.

(56) References Cited

U.S. PATENT DOCUMENTS 5,160,770 A * 11/1992 Hoopengardner ..... 428/41.5
6,216,409 B1 * 4/2001 Roy et al. ..... 52/589.1
6,497,079 B1 12/2002 Pletzer et al.
6,715,253 B2 * 4/2004 Pervan ..... 52/578
6,766,622 B1 * 7/2004 Thiers ..... 52/591.3
6,769,219 B2 * 8/2004 Schwitte et al. ..... 52/592.1
6,772,568 B2 * 8/2004 Thiers et al. ..... 52/592.1
6,898,913 B2 * 5/2005 Pervan ..... 52/589.1
6,922,965 B2 * 8/2005 Rosenthal et al. ..... 52/592.1
6,928,779 B2 * 8/2005 Moriau et al. ..... 52/403.1
7,337,588 B1 3/2008 Moebus
2002/0007608 A1 1/2002 Pervan
2002/0020127 A1 * 2/2002 Thiers et al. ..... 52/403.1
2002/0057942 A1 5/2002 Hamberger et al.
2002/0178681 A1 * 12/2002 Zancai et al. ..... 52/592.1
2003/0029117 A1 * 2/2003 Moriau et al. ..... 52/592.1

(Continued)

FOREIGN PATENT DOCUMENTS

EP 0 974 713 A1 1/2000

(Continued)

*Primary Examiner*—Richard E Chilcot, Jr.
*Assistant Examiner*—William V Gilbert
(74) *Attorney, Agent, or Firm*—Bacon & Thomas, PLLC

(57) ABSTRACT

Floor panel in a board shape having at least at two opposite edges coupling parts enabling several of the panels to be coupled to each other, wherein the coupling parts have contact portions forcing the floor panels in the coupled condition with a tension force at least laterally towards each other. The coupling parts also include support portions, which, in the coupled condition of floor panels, create a fixation in the mutual position of the contact portions cooperating under tension.

23 Claims, 6 Drawing Sheets

U.S. PATENT DOCUMENTS

| | | | | |
|---|---|---|---|---|
| 2003/0154676 | A1* | 8/2003 | Schwartz | 52/391 |
| 2003/0163968 | A1* | 9/2003 | Nel | 52/589.1 |
| 2005/0208255 | A1* | 9/2005 | Pervan | 428/60 |

FOREIGN PATENT DOCUMENTS

| | | | |
|---|---|---|---|
| EP | 1 396 593 | A2 | 3/2004 |
| EP | 1 437 457 | A2 | 7/2004 |
| WO | 97/47834 | | 12/1997 |
| WO | 99/66151 | | 12/1999 |
| WO | WO 00/06854 | | 2/2000 |
| WO | WO 01/51732 | | 7/2001 |
| WO | 01/98603 | A2 | 12/2001 |
| WO | 2004/074597 | | 9/2004 |

* cited by examiner

FLOOR PANEL AND FLOOR COVERING COMPOSED OF SUCH FLOOR PANELS

BACKGROUND OF THE INVENTION

A. Field

This invention relates to a floor panel, as well as to a floor covering composed of such floor panels.

B. Related Technology

More particularly, the invention relates to floor panels, which, at least at two opposite edges, are provided with coupling parts allowing that the floor panels can be coupled to each other mechanically. Examples of such floor panels are described, amongst others, in the patent documents WO 97/47834, WO 01/98603, U.S. Pat. No. 6,769,219, and WO 2004/074597.

SUMMARY OF THE INVENTION

More particularly, the invention relates to a floor panel comprising a board-shaped element, whereby this floor panel, at least at two opposite edges, is provided with coupling parts allowing that several of such floor panels can be coupled to each other, whereby these floor panels, in coupled condition of two of such floor panels, provide in a locking in a first direction perpendicular to the plane of the floor panels, as well as in a second direction perpendicular to the respective edges and parallel to the plane of the floor panels, whereby said coupling parts comprise a tongue and a groove, whereby the groove is situated between an upper lip and a lower lip, whereby the lower lip extends beyond the upper lip, and whereby the coupling parts also comprise locking portions including contact surfaces effecting a locking in said second direction and being formed at least by contact portions, which, in the coupled condition of two of such floor panels, can cooperate with each other, whereby one of these contact portions is situated in the upper side of the lower lip, in such a manner that this contact portion is located at least partially beyond the upper lip, and whereby both said contact portions are situated such that the floor panels, in coupled condition, are laterally forced towards each other with a tension force, causing the contact surfaces to be engaged in compression. Such type of floor panel is known, amongst others, from WO 97/47834, in particular from the form of embodiment represented in FIG. 23 of this document. By means of said tension and reactive compression forces, also called "pretension", the floor panels, in coupled condition, adjoin each other at their visible upper side in an optimum manner and that, when the floor panels, for which reasons whatsoever, are forced apart from each other, there will always be an optimum counteracting force for forcing the floor panels back towards each other.

With the floor panels of the above-mentioned type, it was found that, when walking upon a floor covering that is composed of such floor panels, occasionally it may occur that an undesired sound, more particularly a creaking noise, is produced. As a rule, such floor panels mostly are provided on an elastically compressible underfloor, which either is installed beforehand, or is present below the floor panels in a prefabricated manner, and which may serve for various purposes, such as noise reduction, thermal insulation, leveling of the underfloor, vapor barrier, and so on. As a consequence thereof, when walking on such floor covering, minor movements, mostly mutual tilting movements, will occur among the floor panels, as a result of which noises can be created by the contact surfaces of the coupling parts chafing against each other. Also, in the coupling parts themselves certain deformations may occur as a result of a varying external load, thus also when the floor covering is being walked upon.

In order to remedy the disadvantage of the occurrence of the sounds produced thereby, it has already been suggested to provide a sliding agent on at least one of the coupling parts, more particularly paraffin or the like, for example, as described in WO 00/06854. This technique has as a disadvantage that it requires an additional production cost of the floor panels, although this cost is very small. On the other hand, it has also been found that, notwithstanding the use of such sliding agent, it sometimes still occurs that, when such floor covering is being walked upon, still too many undesired sounds, caused by minor movements among the mutually coupled coupling parts, will occur.

According to a first aspect, the present invention thus aims at an improvement having as an aim to counteract the risk of the occurrence of creaking noises. Hereby, it is aspired to reduce this risk by a suitable design of the profiles of the coupling parts, such that the risk of said undesired noises is reduced even if no sliding agent is applied, which, however, does not exclude that a sliding agent still can be applied on the coupling parts of the floor panels according to the invention.

According to the first aspect, the present invention thus relates to a floor panel of the above-mentioned type, with as a characteristic that said coupling parts also comprise relative position support portions, which, in the coupled condition of such panels, engage each other and cause a fixation in the relative positions of the contact surfaces of the contact portions that are engaged with each other under compression. By means of this fixation is obtained that the coupling parts of two mutually coupled panels, at the height of the contact portions, can no longer perform any mutual shifting relative to each other, when the floor panels, when the floor covering composed thereof is being walked upon, are performing tiny mutual movements. As most of these noises presumably are produced at the height of the aforementioned contact portions along the contact surfaces, this fixation thus also has as a result that the risk that such sounds are created, is considerably reduced, if not the occurrence thereof is completely excluded.

According to a preferred characteristic, the support portions comprise abutment portions preventing a relative mutual shifting between the contact surfaces of the contact portions and thereby effecting the aforementioned fixation.

In the most preferred form of embodiment, the floor panels are characterized in that, in the coupled condition, a tension force causes a reaction compression force between the cooperating contact surfaces of the contact portions, as well as between the contact surfaces of the cooperating support surfaces of the support portions, such that at all the contact surfaces, a so-called "pretension" is present. This has the advantage that, when the contact portion that is situated at the underside of the aforementioned tongue, moves somewhat up and down, the contact portion situated at the aforementioned lower lip necessarily follows in this movement when the panels are coupled.

It is clear that the matter set out above relates to very small movements, which normally may occur with such floor panels. It is also clear that the present invention will not necessarily offer a solution when the floor covering is provided on an underlay or underfloor allowing substantial movements between the panels, for example, an underlay that is so resilient that, when the floor covering is being walked upon, the floor panels thereof perform a movement that is visible to the user.

In particular, the present invention is intended to offer a solution for floor panels of which the coupling panels, or at least the aforementioned contact portions and support portions, consist of wood or a wood-based material, such as, for example, wood fiberboard, particle board, plywood or the like. In particular, the present invention shows its benefit with floor panels whereby at least the aforementioned contact portions and support portions consist of MDF (Medium Density Fiberboard) or HDF (High Density Fiberboard). Preferably, the coupling parts, thus, the tongue and groove structure, consist entirely of such material. In a preferred form of embodiment, these coupling parts hereby also are made in one piece with the core of the floor panels, for example, in that the core is made homogeneously of one of the aforementioned materials, or in that the core, at the location of the respective edges, comprises parts that are made of one of the aforementioned materials.

It is clear that the aforementioned coupling parts as such may have various designs, whereby the floor panels, may be coupled to each other in various ways. The invention is particularly beneficial in the case of coupling parts that allow the mutual coupling two of such floor panels by shifting them towards each other in a common plane, whereby they engage in each other by means of a snap action, as well as in the case of coupling parts that enable two of such floor panels to be mutually coupled by means of an angling movement of one panel relative to the other panel, and, of course, also with coupling parts that are formed such that they enable a joining of the floor panels in both of the above manners.

In particular, the invention is also intended for floor panels of the relatively thin type, by which a thickness of less than 17 mm is meant, which floor panels can be installed as a floating floor, preferably without using glue, and which in particular are intended for being used in homes, offices, shops and the like. In particular, hereby applications in so-called laminated floors are intended, whereby the floor panels mostly have a top layer formed of so-called DPL (Direct Pressure Laminate) or HPL (High Pressure Laminate); however, it may also be used in applications in which the floor panels consist of prefabricated parquet or ready-made parquet, whereby, as known, the top layer consists of real wood; of veneer parquet, whereby the top layer consists of wood veneer; or of massive wood. However, floor panels consisting of other materials are not excluded.

Possibly, a sliding agent, for example, paraffin, oil or the like may be provided on said contact surfaces of the contact portions of the floor panels according to the first aspect. Hereby, it can be effected that, when installing the floor panels, the contact surfaces smoothly slide along each other until the support portions cooperate with each other. Thereby, the risk is reduced that the coupling parts at the contact surfaces of the contact portions might become stuck along each other. When such becoming stuck might occur, an incomplete engagement occurs, whereby the effect of the presence of the support portions defined above will be lost. However, it is clear that the use of such sliding agent according to the invention is an option.

Further, the invention also relates to a number of other aspects that are set forth in the description following hereafter. These aspects may be applied in combination with each other or not.

Various preferred forms of embodiment are possible, to which aim reference is made to the detailed description and appended claims.

DESCRIPTION OF THE DRAWINGS

With the intention of better showing the characteristics of the invention, hereafter, as an example without any limitative character, several preferred forms of embodiment are described, with reference to the accompanying drawings, wherein.

DETAILED DESCRIPTION OF PREFERRED EMBODIMENTS OF THE INVENTION

Figure 1:
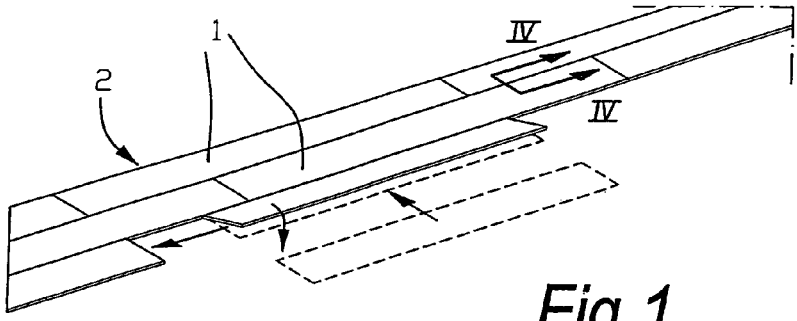
FIG. 1 schematically represents a portion of a floor covering that is composed of floor panels according to the invention.

As represented in FIG. 1, the invention relates to floor panels 1, more particularly hard floor panels, which can be connected to each other in order to form a floor covering 2.

Figure 2:
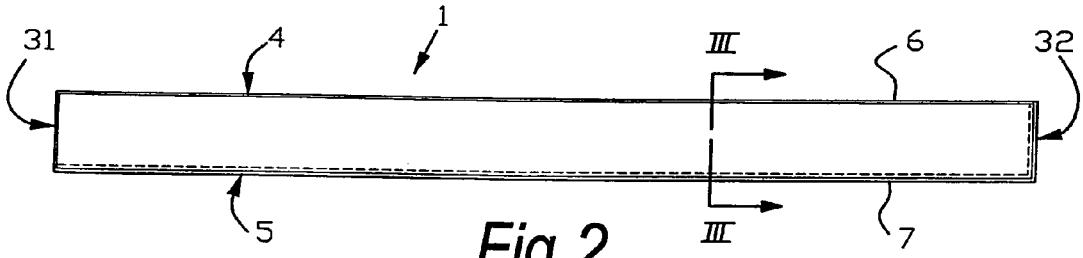
FIG. 2 represents a floor panel of the floor covering of FIG. 1 in top view.
Figure 3:
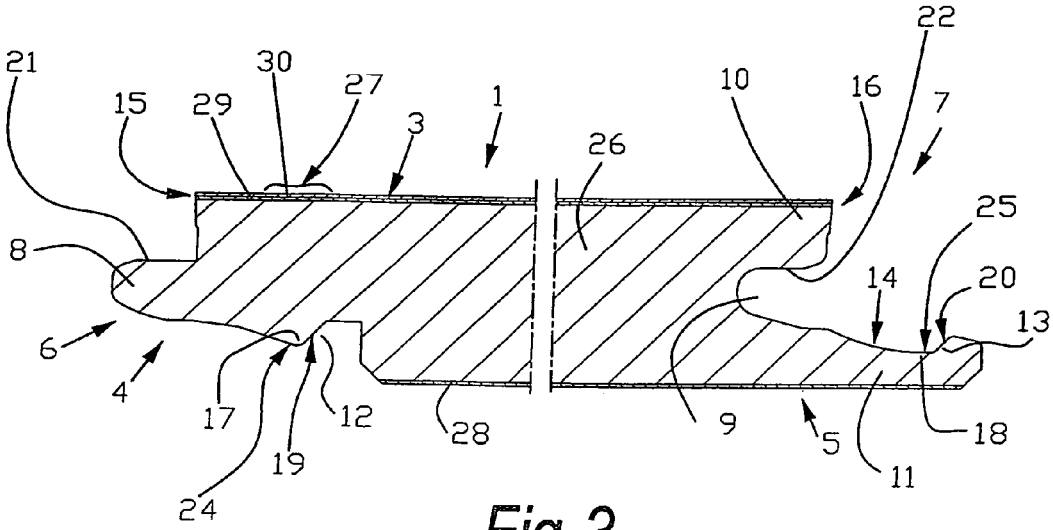
FIG. 3, at a larger scale, represents a cross-section according to line III-III in FIG. 2.
Figure 4:
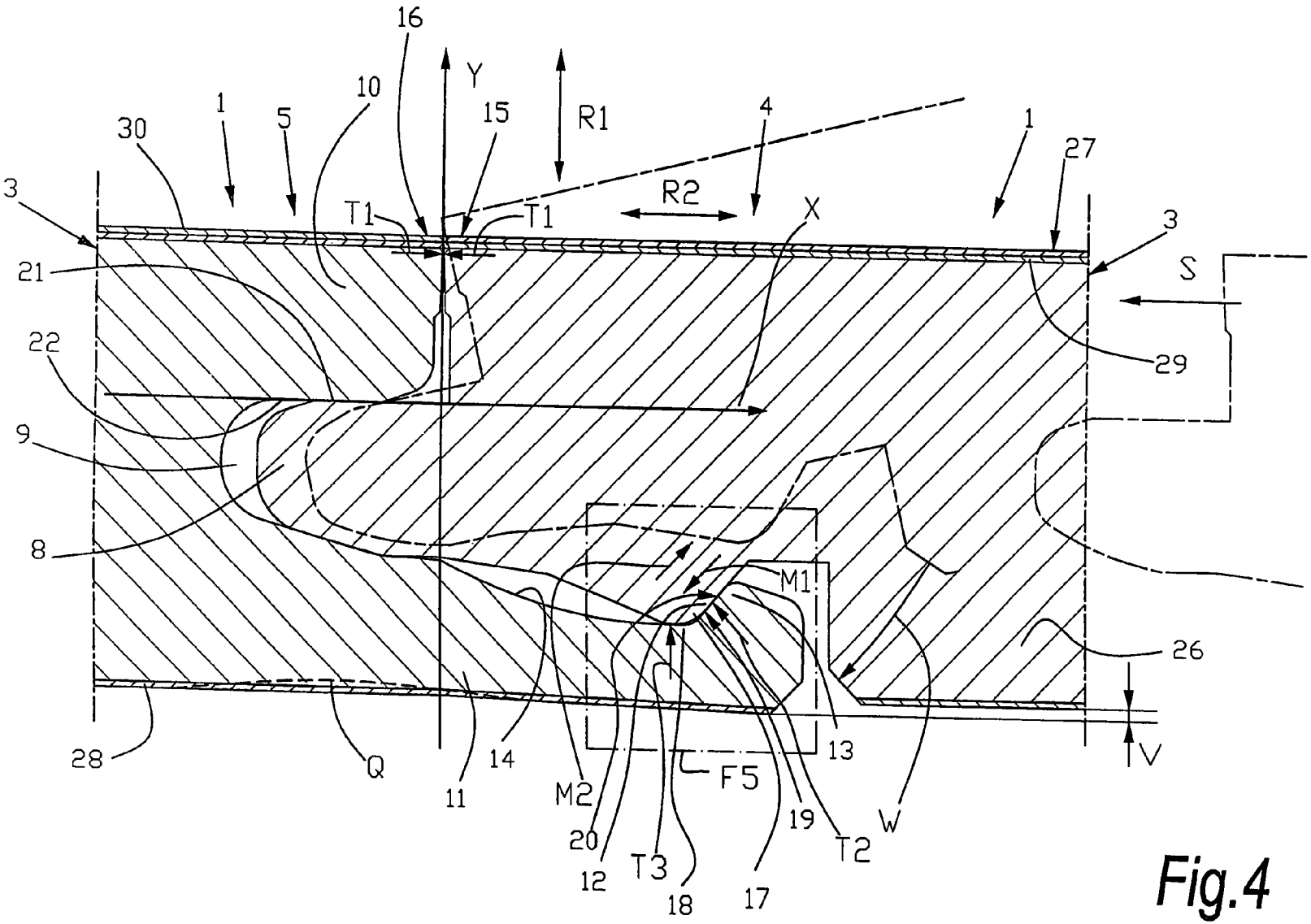
FIG. 4, at an even larger scale, represents a cross-section according to line IV-IV in FIG. 1.

According to the first aspect of the present invention, such floor panel 1 consists of a board-shaped element 3 and this floor panel 1, as represented in FIGS. 2 and 3, at least at two opposite edges 4-5, is provided with coupling parts 6-7 that enable several of such floor panels 1 to be coupled to each other, whereby these coupling parts 6-7, as illustrated in FIG. 4, in coupled condition provide a locking in a first direction R1 perpendicular to the plane of the floor panels 1, as well as in a second direction R2 perpendicular to the respective edges 4-5 and parallel to the plane of the floor panels 1, and further whereby said coupling parts 6-7 comprise a tongue 8 and a groove 9, the groove 9 being located between an upper lip 10 and a lower lip 11, with the lower lip 11 extending distally beyond the upper lip 10. The coupling parts 6-7 also comprise locking portions effecting a locking in said second direction R2 and which are formed by contact portions 12-13, which, in the coupled condition of two of such floor panels 1, can cooperate with each other, whereby one contact portion 13 is located at the upper side 14 of the lower lip 11, and, relative to direction R2, at least distally partially beyond the outer end of the upper lip 10. The contact portions 12-13 also are situated such that the floor panels 1, in coupled condition, are forced with a compression force (called "tension force" in the context of creation of compression by tension forces set up in the lower lip and other forces) T1 at least laterally towards each other, namely at the height of their upper edges 15-16. This results from the contact portion 13 pressing with a "tension" force T2 against the contact portion 12 along the contact surfaces 19, 20. The tension force is generated by an elastic deformation in the lower lip 11, which, in the example of FIGS. 4 to 7, is obtained by the elastic bending of the lip 11, indicated by V, as well as by a slight elastic compression in the material of the coupling parts 6-7.

A feature of the present invention lies in that said coupling parts 6-7 also comprise relative position support portions 17-18, which, in the coupled condition of the respective floor panels 1, create a fixation in the relative mutual positions of the contact portions 12-13 and their respective contact surfaces that are mutually engaged and cooperate with each other under tension, such that a relative shifting between contact surfaces is counteracted.

As represented in FIGS. 4 to 7, these relative position support portions 17-18 preferably are formed as abutment portions located distally beyond the upper lip, as shown. This has as an advantage that, when the contact portion 12 is given a downward movement M1, the contact portion 13 automatically is forced downward too by the support portion 27 engaging support portion 18, and when the contact portion 12 moves back upward, the contact portion 13, in this case, due to the usual elasticity of the lower lip 11, also follows along, so that no relative shifting between the contact surfaces 19-20 of the contact portions 12-13 takes place and, therefore, the risk of said undesired creaking noises is reduced.

More particularly, the coupling parts 6-7, due to an overlapping design of the basic profiles, are configured such that, in coupled condition, a "tension" force is generated not only at the contact portions 12-13 via the contact surfaces, but a "tension" force T3 is also generated at the relative position support portions 17-18. This has as the effect that, when the contact portion 12 is moved downward and subsequently moves back up, the lower lip 11 follows this movement with great certainty. Moreover, this also has the effect that, when, as a result of the floor panels 1 being walked upon, the contact portion 12 performs a small upward movement, more particularly according to the direction M2, for example, because the coupled floor panels 1 are mutually shifting relative to each other somewhat in height and/or are turning somewhat relative to each other, the upward movement M2 of the contact portion 12 also is followed by the contact portion 13, such that, in this case, too, the occurrence of undesired creaking noises as a result of mutual shifting of the contact surfaces 19-20 is excluded, or at least minimized.

How the profiles of the coupling parts 6-7 might be designed in order to simultaneously create such tension forces T2 and T3 is explained below by way of example, referring to FIGS. 5 to 7.

Figure 5:
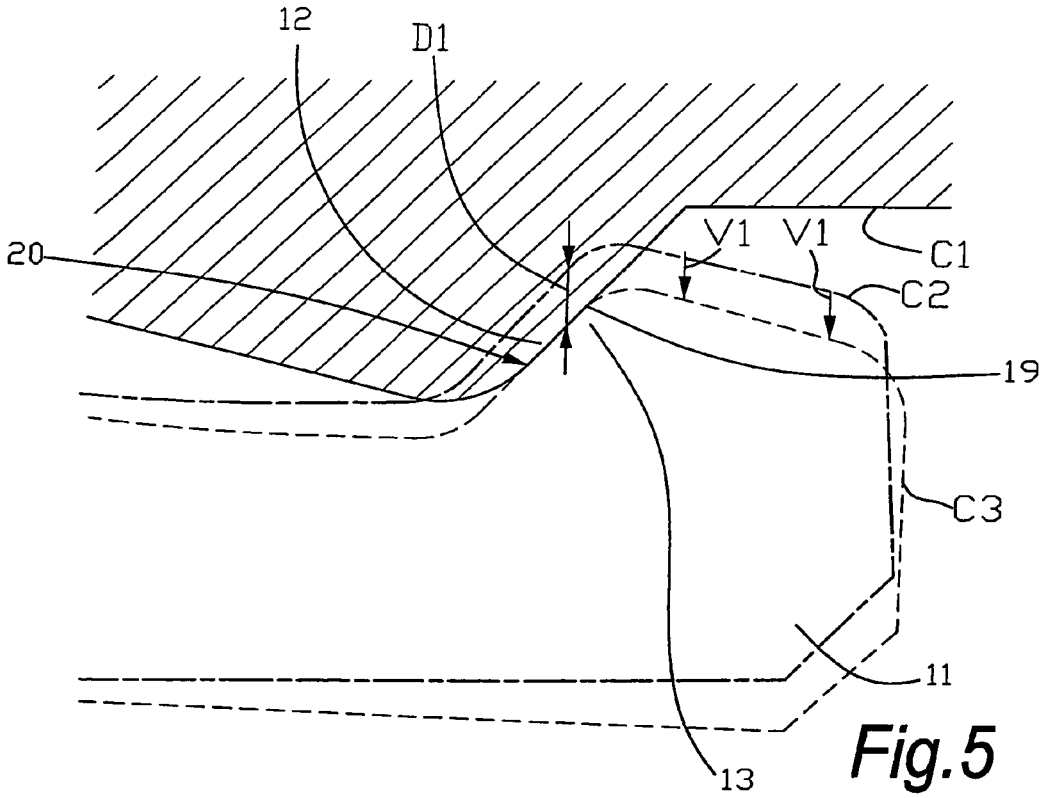
FIGS. 5 to 7 represent a number of schematic illustrations referring to the portion indicated by F5 in FIG. 4.

In FIG. 5, the lines C1 and C2 represent portions of the adjacent surface profiles or contours of the coupling parts 6 and 7, more particularly of the contact portions 12 and 13, the contact surfaces 19, 20 and of the support portions 17, 18. The lines C1 and C2 represent the profiles in an unloaded or non-tensioned condition (i.e., no "pretension"), with the upper edges 15, 16 of the respective profiles laterally engaged against each other, and the upper side 21 of the tongue 8 seated against the underside 22 of the upper lip 10. In order to create said "pretension" in the direction R2, there is a certain overlapping provided between the contours, such overlap defined as the vertical distance between the contours C1, C2 being indicated by D1 in FIG. 5.

According to a theoretical approach, whereby it is presumed that the pretension is created exclusively by an elastic bending of the lower lip 11 and this lip, at the location of the contact portion 13, solely angles downward about a theoretical turning point, upon coupling of the represented floor panels 1, a condition is created whereby the distal extremity of the lower lip 11 moves into a position as indicated by line C3, whereby all points defining the location of the contact portion 13 and in the direct proximity thereof undergo an almost vertical displacement V1.

Figure 6:
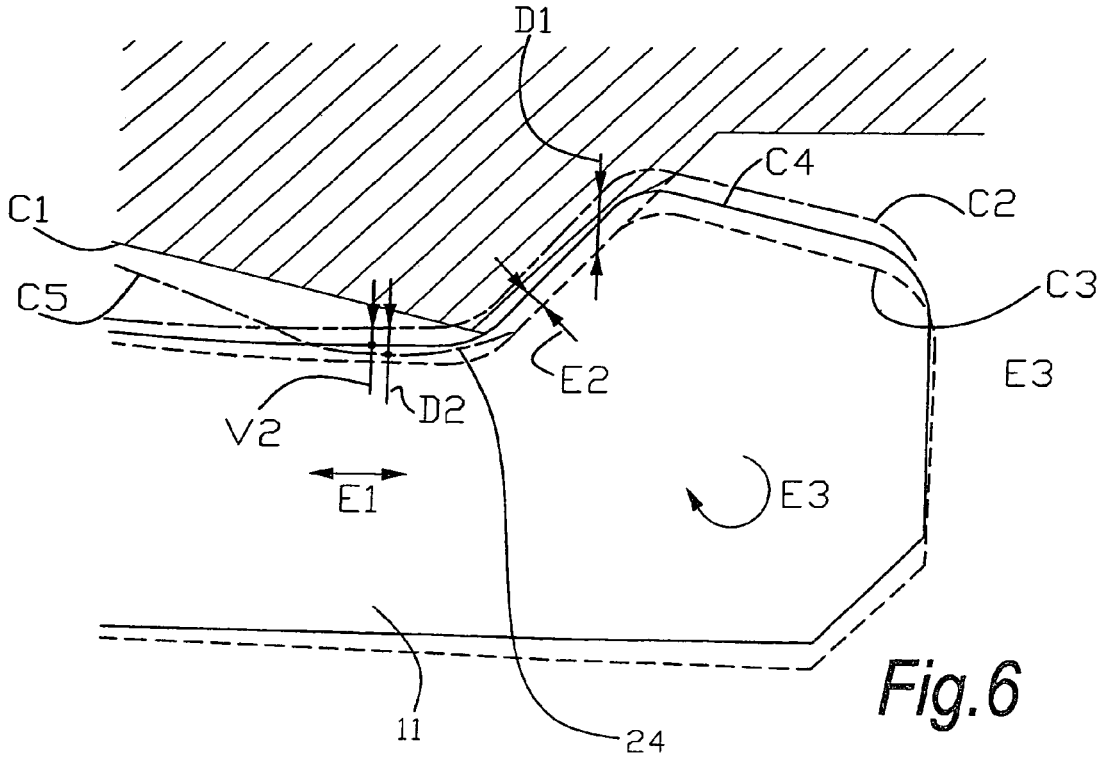

As represented in FIG. 6, the actual displacement, however, is smaller, and the distal extremity of the lower lip will not take a position as shown by said line C3, but, will instead be located at a position between C2 and C3, which is schematically indicated by line C4. The actual displacement of the distal extremity of the lower lip 11 in fact is also influenced by, amongst other factors, the elasticity E1 in the relatively thin lower lip 11, the elastic and/or plastic impression (compression) E2 at the location of the contact surfaces 19-20 and a tilting or torsion movement E3 in the distal portion of the lower lip 11. This may also be influenced by other effects, such as, for example, a deformation Q in the proximity of the base of the lower lip, which may result from internal tensions.

By choosing, when designing the coupling parts 6-7, the profiles such that the contour of the coupling part 6 at the height of the support portions 17-18 to be realized extends, in free condition (without pretension), up to between the lines C3 and C4, which, for example, is obtained by replacing the contour according to line C1 by the one according to C5, the effect intended according to the invention can be realized. In fact, when the contour is systematically adapted from line C1 towards line C5, a "tension" (i.e., compression) force at the contact surfaces of the support portions 17-18 is created when this contour becomes situated below line C4. Should this line become lower than line C3, however, the contact at the contact portions 12-13 would be interrupted (i.e., the contact surfaces will be disengaged).

It is noted that the above outline solely relates to a theoretical approach and, thus, does not exclude that in reality, deviations thereof are possible without departing from the scope of the invention.

Rather generally speaking, however, it may be assumed that, in order to realize the invention, it is preferred that the respective edges 4-5 of the floor panels 1 are provided with profiles, in other words, contours in cross-section, which, in their unloaded condition, have an overlapping relationship, at the location of the contact portions 12-13 as well as at the location of the support portions 17-18. It is clear that such overlaps, which are indicated by D1 and D2 in FIG. 6, in practice can be measured by means of a measuring bench, possibly in order to perform periodic controls of the production. When such overlaps D1 and D2 are present, it can be assumed that the invention is implemented. Such measurements may be performed on a 3D measuring bench. In order to check whether the overlaps are present, co-ordinate systems must be drawn of the measured profiles, at the location represented in FIG. 4, and the measuring results of edge 4 and edge 5 must be put on top of each other (overlayed) with the co-ordinate systems.

Preferably, the overlap D2 at the support portions 17-18, existing in the vertical direction, is smaller than the overlap D1 at the contact portions 12-13, existing in the vertical direction.

More particularly, it is preferred that the overlap D2 at the support portions 17-18, measured in the vertical direction, is smaller than the theoretical vertical displacement of the overlap D1 at the contact portions 12-13, yet, is larger than the actual vertical displacement, so that this actual vertical displacement preferably represents the actual vertical displacement V2 at the height of the support portions 17-18, which would occur when no contact is made between the support portions.

The actual vertical displacement occurring at the support portions 17-18 when the latter indeed are in contact with each other will deviate a little, but not considerably, from V2, such that this actual displacement may be considered as being equal to V2.

In view of the fact that V2, however, is difficult to be determined beforehand, but is situated somewhere in the middle between the lower lip unbent relaxed position according to line C2 and the theoretically fully bent position according to line C3, and in view of the fact that the vertical distance between lines C2 and C3 approximately is equal to D1, it is preferred that said vertical overlap D2 at the support portions 17-18 is approximately one-half of the vertical overlap D1 at the contact portions 12-13.

It is clear that a suitable overlapping can also be determined by means of tests, whereby it is not excluded that in certain cases, other overlapping values must be applied in order to create the aforementioned inventive effect.

Figure 7:
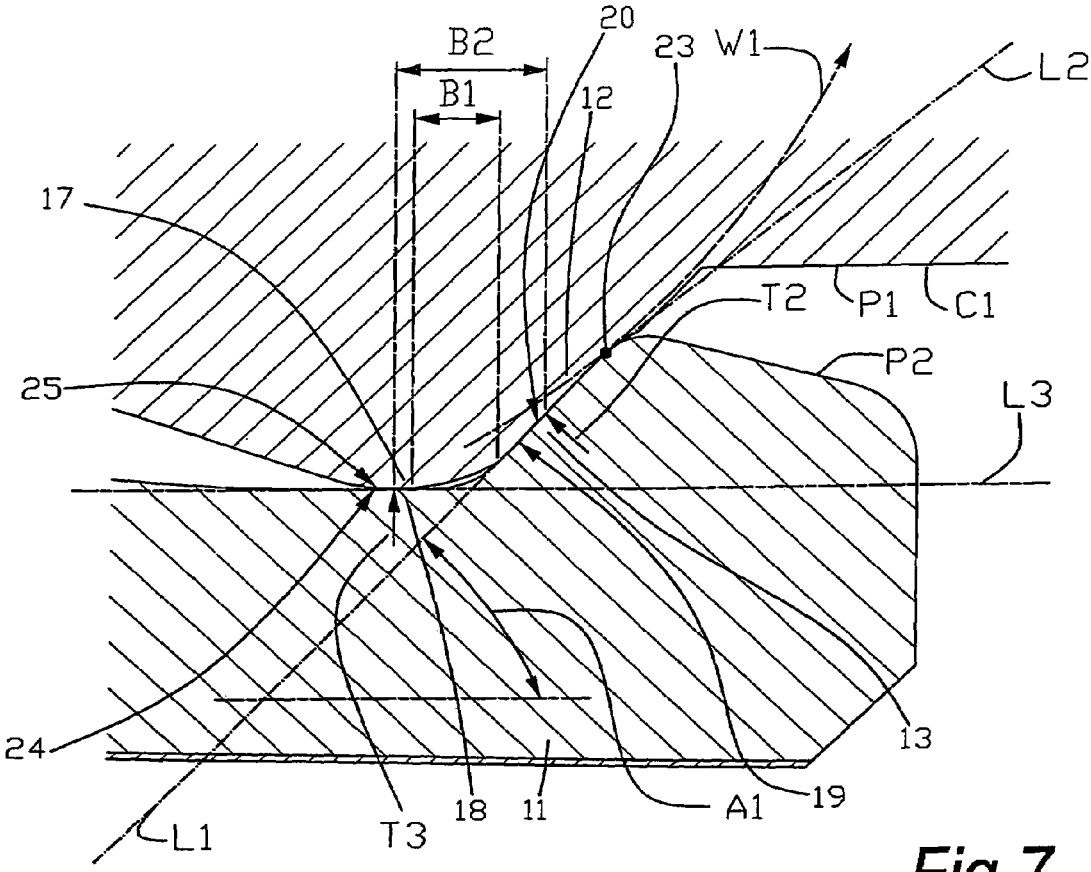

It is noted that the definitions of overlapping of the profiles given above, in particular are suitable for being applied in embodiments whereby the contact portions 12-13 have contact surfaces 19-20, which in the coupled condition define a tangent L1 that is obliquely inclined in respect to the plane of the floor panels 1, which is indicated by angle A1 in FIG. 7.

In the case of contact portions 12-13 with inclined contact surfaces 19-20, preferably also one or more of the criteria described below will exist.

According to a preferred form of the invention, the coupling parts 6-7 have contact surfaces, which, at least at one place where they cooperate with each other, define a tangent L1 forming an angle A1 with the plane of the floor panels that is smaller than 80 degrees. Moreover, this angle preferably is larger than 30 degrees. Still better, the contact portions have, in or next to their uppermost contact point, a tangent line that is inwardly downwardly inclined and forms an angle with the plane of the panel that is situated between 30 and 70 degrees.

In the case where the floor panels 1 possess coupling parts 6-7 that, as represented in FIG. 4, enable the floor panels 1 to be coupled and/or uncoupled by means of an angling movement W, the floor panel 1 according to the invention possibly may be further characterized in that, in the coupled condition of two of such floor panels 1, the contact portions 19-20, seen in a cross-section, define a tangent line L1 in or next to their highest-situated contact point 23, said tangent line deviating less than 30 degrees from the tangent line L2 through the same contact point 23, while extending, tangential to the angling curve W1 drawn through this point, said curve being followed by the floor panels 1 when angled in or angled out.

It is noted that by the expression "highest contact point 23" means that the highest point where the contact portions 12-13 cooperate with each other in a normal manner, and thus no higher-situated contact points in transition zones exists, because there is no clearly defined cooperation among the contact portions.

The aforesaid, however, does not exclude that the aforementioned criteria are also applied for embodiments where the tangent line L1 forms an angle A1 with the plane of the floor panels 1 that is larger than 80 degrees and may even be 90 degrees.

Figure 8:
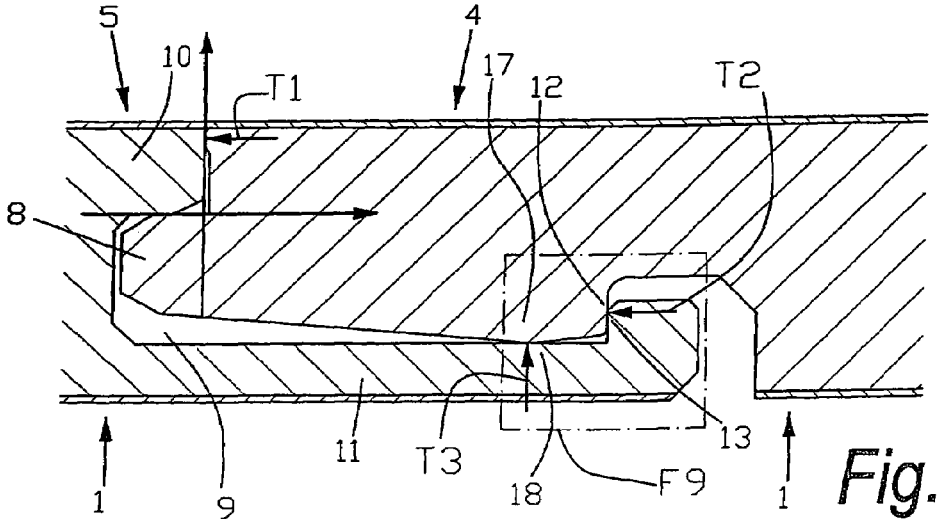
FIG. 8 represents a view similar to that of FIG. 4, however, for a variant.
Figure 9:
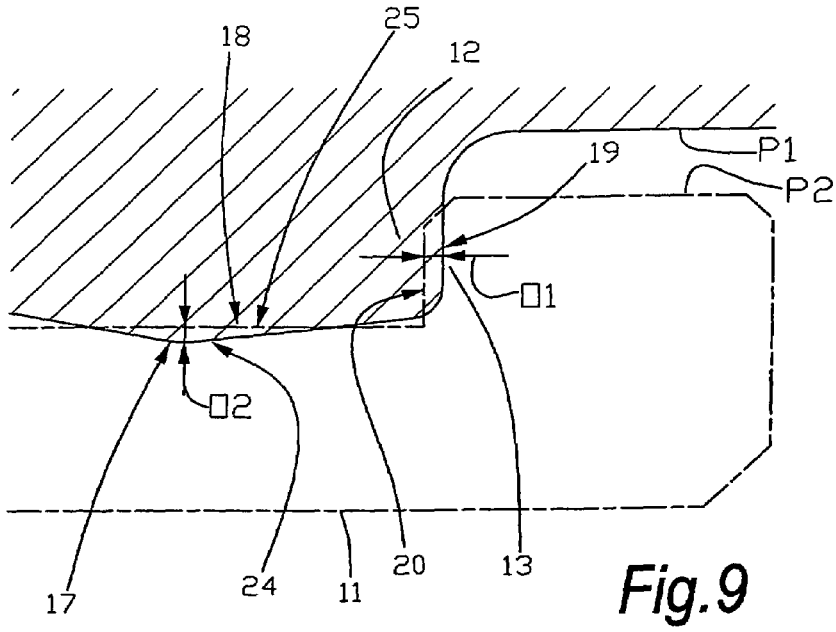
FIG. 9 represents a portion of the coupling parts of FIG. 8, however, in unloaded condition.

In the case that the contact portions 12-13 define a tangent line L1 forming an angle with the plane of the floor panels 1 that is larger than 80 degrees, for example 90 degrees, the criteria in respect to the ratio between the overlap produced at the contact portions 12-13 and the overlap produced at the support portions 17-18 in fact are less important or sometimes even not relevant and virtually any overlap produced by the support portions effects a desired result. An example of floor panels according to the first aspect of the invention, whereby vertical contact surfaces 19-20 are used, is represented schematically in FIG. 8. In accordance with the invention, the coupling parts, apart from the contact portions 12-13, also possess relative position support portions 17-18, so that, in the coupled condition, tension produced compression forces T2 and T3 prevail between the contact portions 12-13 and the support portions 17-18. Practically, this can be accomplished by using coupling parts, the profiles of which produce overlaps O1 and O2, at the location of the contact portions 12-13 as well as at the location of the support portions 17-18, as schematically illustrated in FIG. 9.

Preferably, at least one of the contact portions 12-13 will have a flat contact surface 19-20, however, still better both contact portions 12-13 have flat contact surfaces 19-20, as is also represented in the FIGS. 4 to 9.

Preferably, also at least one of the contact surfaces 24-25 of the support portions 17-18 is formed as a flat surface. Preferably, this is the contact surface 25 located at the lower lip 11.

Such flat contact surfaces 19-20-24-25 have as an advantage that it is possible to keep production tolerances better under control, especially when the coupling parts 6-7 are formed by means of machining tools, such as milling tools. Moreover, control measurements then are easier to perform.

According to a particular characteristic, which, however, is facultative, it is preferred that one of the support portions 17-18 is made convex or with a tip, in such a manner that the cooperation of the support portions 17-18, more or less occur as a point contact. In reality, this allows that the support portion 17 can effect a compression in the support portion 18 in a somewhat smoother manner, with as a result that a balanced condition can be brought about more easily, whereby at the contact portions 12-13 as well as the support portions 17-18 a suitable "tension" force exists as described above.

Preferably, the support portions 17-18 define at their contact zone, preferably in the middle of this zone, a tangent line L3 that is parallel to the plane of the panel or deviates from this plane with an angle that is smaller than 30 degrees.

Further, it is also preferred that the support portions 17-18, seen in cross-section, and according to a direction perpendicular to the coupled edges 4-5 and in the plane of the floor panels 1, are located at a short distance in front of or behind the contact portions 12-13. More particularly, it is preferred that the distance between the contact surfaces of the contact portions 12-13 and the support portions 17-18, which distance is indicated by B1 in FIG. 7, is less than 2 millimeters and still better is less than 1 millimeter. Still better, also the distance B2 between the middle areas of the contact zones at the support portions 17-18 and contact portions 12-13 is smaller than 2 millimeters, and still better smaller than 1 millimeter. In combination herewith, the tangent lines L1 and L2 preferably form a mutual angle that is smaller than 150 degrees.

In the form of embodiment of FIGS. 3 to 9, the support portions 17-18 are located towards the interior side of the panel, next to the contact portions 12-13. It is noted that, according to a variant not shown, the support portions 17-18 also may be located at the exterior side, with which is meant that they then, for example, are situated at the height of the locations P1 and P2 indicated in FIGS. 7 and 9 and that the coupling parts there contact each other and, in unloaded condition, have overlapping profiles there.

In the FIGS. 3 to 9, different embodiments are shown wherein the floor panels consist of laminate panels with a continuous board-shaped core 26 of MDF or HDF, upon which, at the upper side, a layer-shaped laminate top structure 27 is provided and, at the underside, at least one backing layer 28 is present and wherein the coupling parts 6-7 are manufactured in one piece of the core 26 of the panel, preferably by means of a milling procedure. In the example of FIGS. 4 to 7, the laminate top structure 27 is composed of a printed decor layer 29 and a so-called overlay 30, which preferably consist of a carrier impregnated with resin, for example, melamine resin, and which is pressed upon the upper side of the core 26, for example, according to the generally known technique for forming DPL (Direct Pressure Laminate). In the top structure, and more particularly in the overlay 30, materials may be provided to enhance wear resistance, such as corundum particles. The backing layer 28 usually consists of a resin-treated paper layer that is pressed against the underside of the core and has as its purpose to effect a balancing, in particular to counteract bending effects that might occur as a result of tensions between the material of the core 26 and of the laminate top structure 27.

Although the invention first of all is intended to be applied with such floor panels 1, it is clear that it is not limited to such floor panels.

More particularly, the invention is useful in combination with coupling parts 6-7 that enable coupling and/or uncoupling of two of such floor panels 1 with or from each other, by means of an angling movement, for example, angling movement W, as indicated in FIG. 4. When using such floor panels 1 with this type of coupling parts, when walking upon a floor covering 2 constructed thereof, automatically the effect is created that the floor panels 1 have the tendency to slightly rotate with respect to each other, as a consequence of which creaking noises may occur, which then, due to the present invention, can be excluded, or can at least be minimized.

The invention is also useful in combination with coupling parts 6-7 that enable coupling two of such floor panels together by shifting them towards each other in a common plane, as indicated by arrow S in FIG. 4, whereby they engage each other by means of a snap action involving bending of the lower lip during coupling followed by a snap return of the lower lip towards a position occupied by the lower lip before coupling. When using floor panels 1 with this type of coupling parts 6-7, the height of the contact portions 12-13 mostly is small, and the lower lip 11 mostly is rather flexible. As a result thereof, the lower lip generally is less stable than with coupling parts coupled exclusively by angling movement. Due to this lower stability, movements in the lower lip may occur during a varying load that results when the floor panels 1 being walked upon, as a consequence of which creaking noises may occur, which then, due to the present invention, can be excluded, or at least minimized.

It is clear that the invention may be applied at one or more pairs of opposite edges of floor panels. In the case of rectangular panels, either square panels or elongated panels, for example, as represented in FIG. 2, the invention may be applied at the first pair of opposite edges 4-5 as well as at the second pair of opposite edges 31-32, wherein the coupling parts 6-7 of the two pairs may or may not be identical.

Possibly, the lower lip 11 may be made thinner than the upper lip 10. Preferably, the tongue is a solid element, and preferably, no split tongue is used.

According to a particular form of embodiment of the invention, on at least one of the contact portions 12-13 a sliding agent, for example, paraffin or oil, will be applied. This offers as an additional advantage that the contact surfaces 19-20 of the contact portions 12-13 will slide alongside each other more smoothly during the coupling of the floor panels 1. Thus, the risk is reduced that the contact portions 12-13, during the forming of the coupling, will get stuck along each other and the support portions 17-18 might not come into contact with each other, whereby the effect of the invention might be lost.

Although the invention is particularly useful with floor panels wherein the contact portion 13 according to the direction R2 is located at least partially beyond or external of the upper lip 10, and still better is situated entirely at a distance beyond it, it may also be used with embodiments wherein this is not the case and the contact portion in the lower lip then is situated entirely within the distal extremity of the upper lip 10. Thus, the lower lip 11 may project with its extreme distal end either beyond the upper lip, may be equal therewith or may be shorter than the upper lip.

It is clear that the invention is not limited to laminate panels, wooden panels or panels with a layer of wood at the top surface. Amongst others, it also relates to floor panels 1 that are provided with a special top layer at their upper side consisting, for example, of cork, natural stone, imitations of stone, such as stone composite, ceramics, carpet product, such as wall-to-wall-carpet, felt and the like, and so on.

Figure 10:
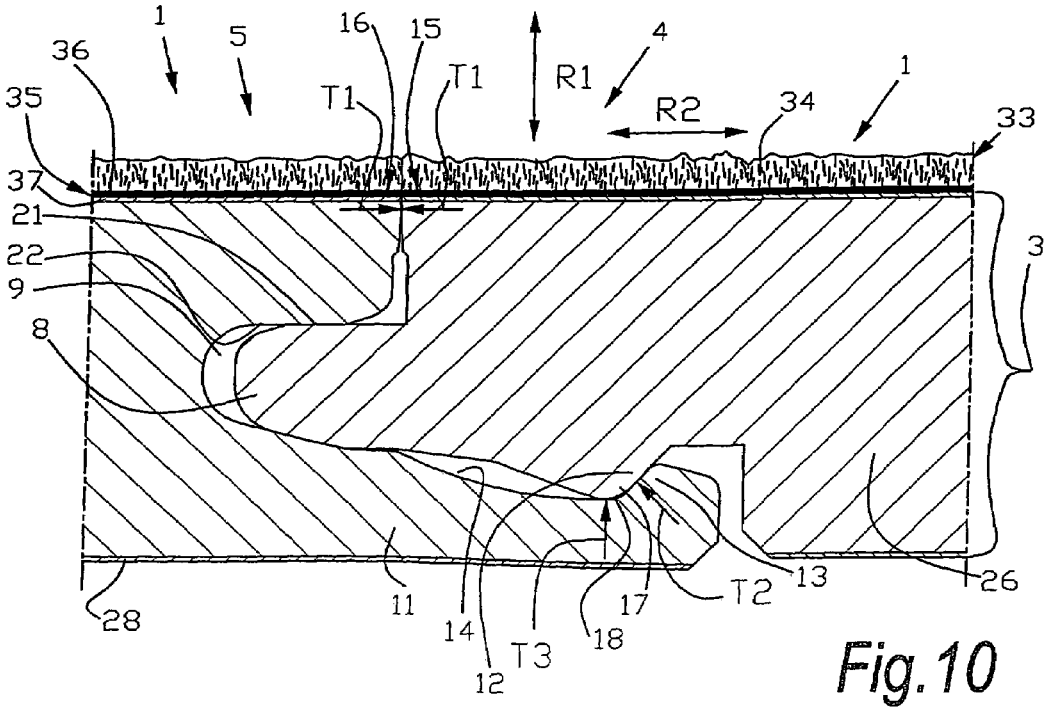
FIG. 10 represents a view similar to that of FIG. 4, but wherein a second, third, and fourth aspect of the invention are applied.

FIG. 10 shows a form of embodiment that is comparable to that of FIG. 4, however, wherein the floor panel 1, apart from the board-shaped element 3, also has a top layer 33 consisting of a carpet product 34. By carpet product, thus, any form of carpet or carpet-like product must be understood. Thus, amongst others, carpet with upstanding fibers as well as felt carpet and the like may be used.

According to an important aspect, at least two opposite edges 4-5 of the floor panels 1 are formed such that the "tension" forces T1 are taken up at least partially, however, preferably completely or to a major part by the actual board-shaped element 3 and not or almost not by the layer 33 consisting of the carpet product 34. In this manner, the mutual positioning of coupled floor panels 1 can not be disadvantageously influenced by too large forces between the adjacent layers of carpet product. This aspect, hereafter denominated second aspect, may either be applied in combination with the first aspect or not. In general, the present invention thus according to a second aspect relates to a floor panel 1, at least consisting of a board-shaped element 3 and a layer 33 of carpet product 34 directly or indirectly attached thereupon, wherein this floor panel 1, at least at two opposite edges 4-5, is provided with coupling parts enabling several of such floor panels 1 to be coupled to each other, whereby these coupling parts, in coupled condition of two of such floor panels 1, provide for a locking in a first direction R1 perpendicular to the plane of the floor panels 1, as well as in a second direction R2 perpendicular to the respective edges 4-5 and parallel to the plane of the floor panels 1, wherein these coupling parts 6-7 preferably comprise a tongue 8 and a groove 9, wherein the groove 9 is situated between an upper lip 10 and a lower lip 11, and wherein the coupling parts 6-7 also comprise locking portions effecting a locking in said second direction R2 and comprise contact portions 12-13, which, in the coupled condition of two of such floor panels 1, can cooperate with each other, wherein said contact portions 12-13 are situated such that the floor panels, in coupled condition, are forced towards each other with a "tension" force T1, further wherein said opposite edges 4-5 of the floor panels 1 hereby are formed such that said tension forces T1 are at least partially, however, preferably entirely or largely, taken up by the actual board-shaped element 3. It is clear that this may be realized by applying suitable measures, which, starting from the above-formulated inventive idea, may be effected by a person skilled in the art.

According to a third aspect, the invention relates to a floor panel 1 that, as represented in FIG. 10, comprises a board-shaped element 3 of wood or of a wood-based product, upon which a layer 33 of carpet product 34 is provided, with as a characteristic that between the board-shaped element 3 and the layer 33 of carpet product 34, at least one layer 35 is provided forming a barrier against the permeation of liquids. Thereby, the risk is reduced that liquids, and also strong vapors that may be employed, for example, when cleaning the carpet product 34, may end up in the board-shaped element 3, and therefore deformations as a result thereof are excluded.

The barrier may be formed by a glue layer 36 extending at least over 90% and preferably 100% of the surface of the board-shaped element 3, whether or not in combination with other layers, whereby this glue layer 36, for example, is also used for the attachment of the carpet product 34.

According to a particular form of embodiment, for the barrier at least a particular layer of material will be used, which is liquid-tight. As represented in FIG. 10, this may be a laminate layer 37, which as such may be composed of one or more layers. Preferably, this relates to a laminate layer 37 based on melamine. The laminate layer 37 is preferably provided on the board-shaped element 3 by means of DPL technique.

FIG. 10 uses both layers, in other words, the glue layer 36 and the laminate layer 37, for forming said barrier, however, it is clear that it might also be possible to use only one of these layers as a barrier. The use of a laminate layer 37 offers a better guarantee for water impermeability than, for example, the glue layer 36. In the case of such laminate layer 37, this preferably consists of only one layer, in other words, one resin-treated carrier, contrary to usual laminate top structures 27 that mostly are constructed of two layers, such as the aforementioned decor layer 29 and overlay 30. Preferably, the laminate layer 37 also is free of especially admixed particles in order to enhance wear resistance, in view of the fact that those would not have any purpose in this product. In this manner, the laminate layer 37 may be formed in a rather inexpensive manner. Preferably, a completely watertight barrier is applied, such that humidity will penetrate downward exclusively along the coupled edges, where the risk of permeation, however, is small.

According to a fourth aspect, the invention relates to a floor panel 1, which, as represented in FIG. 10, comprises a board-shaped element 3 upon which a layer 33 of carpet product 34 is provided, with the characteristic that the board-shaped element 3 comprises a core 26 of wood or of a wood-based product, and with the characteristic that this board-shaped element has a sandwich structure, whereby the core 26 preferably is located between a top layer and a balancing backing layer. By means of this combination, a solid construction is obtained that is little subjected to deformations under external influences, even if the board-shaped element 3 has a small thickness. The core preferably consists of a single continuous MDF or HDF board. The top layer and backing layer preferably consist of laminate layers based on resin, more particularly of resin-impregnated paper layers that are pressed upon the core 26. In the example of FIG. 10, those are the laminate layer 37 and the backing layer 28.

Figure 11:
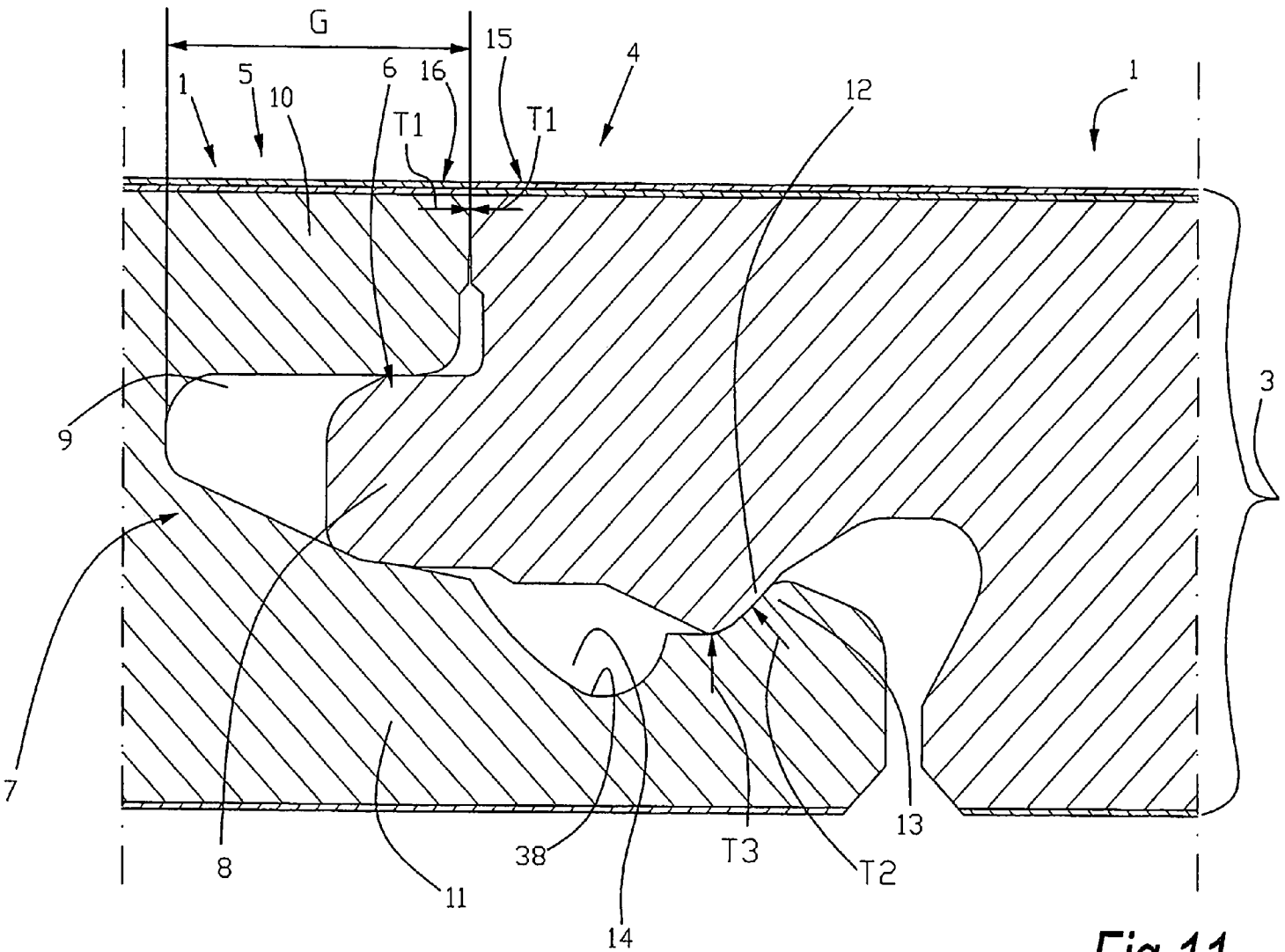
FIG. 11 represents a view of coupling parts realized according to the first aspect of the invention.

Finally, FIG. 11 represents a variant of the first aspect of the invention, whereby immediately in front of the support portion, a recess 38 is provided in order to enhance the flexibility of the lower lip 11.

According to the embodiment of FIG. 11, preferably the depth G of the groove 9 is larger than or equal to 0.4 times the thickness of the board-shaped element 3, whereas the distance with which the lower lip reaches beyond the upper lip, is smaller than 1.3 times the thickness of the element 3.

The lowermost support portion is formed flat and horizontal and projects as an elevated portion above the recess 38, due to which this plane is particularly suitable as a measuring point for control measurements in respect to production accuracy.

The present invention is in no way limited to the embodiments described by way of example and represented in the figures. On the contrary, the floor panel be made in various forms and dimensions without departing from the scope of the invention. Also, all aforementioned aspects of the invention may be combined randomly. In the case of elongated panels, the coupling parts formed according to the invention may be used either at the long side, or at the short side, or at the long as well as the short sides.

Finally, it is to be noted that, by the expression "contact portions", is always meant the locking portions that are intended to effect the horizontal locking. The "board-shaped element 3" may possess a single continuous core, or, may also be composed of several parts and thus also may consist of "plywood", "block board" or the like.

The invention claimed is:

1. Floor panel, comprising a board-shaped element, including at least at two opposite edges coupling parts enabling several of such floor panels to be coupled to each other, such that said coupling parts, in coupled condition of two of such floor panels, provide a locking in a first direction perpendicular to the plane of the floor panels, as well as in a second direction perpendicular to the respective edges and parallel to the plane of the floor panels, wherein said coupling parts comprise a tongue having an upper and lower side and a groove, further wherein the groove is located between an upper lip having a lower side and a lower lip, the lower lip having an upper side and extending distally beyond the upper lip, and the coupling parts including locking portions effecting a locking in said second direction and being at least formed by contact portions including contact surfaces having lower ends located distally beyond said upper lip, and which, in the coupled condition of two of such floor panels, contact and cooperate with each other, wherein one of said contact portions is situated in the upper side of the lower lip, such that said one contact portion is located beyond the upper lip and wherein said contact portions are situated such that the floor panels, in coupled condition, are urged with a tension force at least laterally towards each other, and wherein said coupling parts also comprise cooperating support portions on the lower side of the tongue and the upper side of the lower lip, which, in the coupled condition of the respective floor panels, are located adjacent the lower ends of the contact surfaces, are disposed distally beyond the upper lip, and engage and contact each other and cause a fixation in the relative positions of the contact surfaces of the contact portions relative to each other, while said contact surfaces of said contact portions cooperate under tension, whereby relative sliding between said contact surfaces is prevented when the panels undergo vertical or rotation forces tending to slightly move the surfaces relative to each other.

2. Floor panel according to claim 1, wherein the support portions are configured as abutment portions disposed on the lower side of the tongue and the upper side of the lower lip.

3. Floor panel according to claim 1, wherein in the coupled condition, a tension force exists also between the cooperating support portions.

4. Floor panel according to claim 1, wherein the coupling parts including the contact surfaces and the support portions of said coupling parts are provided with opposed surface profiles, which, in their uncoupled and non-tensioned condition, and viewed in transverse cross-section with upper edges of the panels laterally in contact with each other and an upper side of the tongue in contact with a lower side of the upper lip, assume first positions, and in their coupled and tensioned condition, assume second positions, wherein the difference between said positions, termed overlap, is such that the degree of overlap, measured in the vertical direction, between the adjacent support portions is smaller than the overlap, measured in vertical direction, between the adjacent contact surfaces of the contact portions.

5. Floor panel according to claim 4, wherein vertical overlap at the support portions is approximately one-half of vertical overlap at the contact portions.

6. Floor panel according to claim 4, wherein the overlap, measured in a vertical direction, at the support portions is smaller than a theoretical vertical displacement between the contact portions when the coupling parts are under tension, and is larger than the actual vertical displacement under such tension, such that the actual vertical displacement represents the actual vertical displacement at the height of the support portions that would occur if no contact between the support portions existed.

7. Floor panel according to claim 1, wherein, in the coupled condition of the respective floor panels, the contact surfaces of the contact portions, at the location where they cooperate with each other, define a tangent line forming an angle with the plane of the floor panels which is smaller than 80 degrees.

8. Floor panel according to claim 1, wherein the contact portions define a tangent line forming an angle with the plane of the floor panels that is larger than 80 degrees.

9. Floor panel according to claim 1, wherein, in the coupled condition of two of such floor panels, the contact portions seen in a cross-section, in or next to their highest-located contact point define a tangent line deviating less than 30 degrees from the tangent line through the same point, and tangential to an angling curve drawn through this point, said curve being a curve followed by the floor panels when angling them in or out relative to each other.

10. Floor panel according to claim 1, wherein at least one of the contact portions comprises a flat contact surface.

11. Floor panel according to claim 1, wherein at least one support portion has a flat support surface.

12. Floor panel according to claim 11, wherein the other support portion has a convex or pointed shape.

13. Floor panel according to claim 1, wherein the support portions define a tangent line which is parallel to the plane of the floor panel or deviates from this plane with an angle that is smaller than 30 degrees.

14. Floor panel according to claim 1, wherein the floor panel, at least at the height of the contact portions and the support portions, comprises wood or a wood-based product.

15. Floor panel according to claim 14, wherein said wood-based product is MDF or HDF.

16. Floor panel according to claim 1, wherein the coupling parts are entirely formed of MDF or HDF.

17. Floor panel according to claim 1, wherein the coupling parts are manufactured in one piece from the core of the floor panel.

18. Floor panel according to claim 1, wherein the coupling parts are configured so that upon coupling of two panels along mutual side edges with a tongue on one panel received in the groove of the other panel, the respective contact surfaces are brought into locking contact with each other with a deformation of the lower lip from a position before coupling and then a return of said lower lip towards said position before coupling by a snap action as coupling is completed.

19. Floor panel according to claim 1, wherein the coupling parts are configured such that two of the respective floor panels can be coupled to each other by means of an angling movement wherein one panel by its side edge is angled-in to the side edge of the other panel until a tongue of one panel is fully received in a groove of the other panel, with the contact surfaces in contact with each other.

20. Floor panel according to claim 1, wherein the floor panel has a thickness of less than 17 mm.

21. Floor panel according to claim 1, wherein the panel is a laminate panel of the type having a continuous board-shaped core comprising MDF or HDF, a laminate top structure situated thereupon, comprising at least a printed and resin-impregnated decor layer, as well as a backing layer at the underside of the floor panel.

22. Floor panel according to claim 1, wherein at least on one of the contact portions, a sliding agent is provided.

23. Floor panel, comprising a board-shaped element, including at least at two opposite edges coupling parts enabling several of such floor panels to be coupled to each other, such that said coupling parts, in coupled condition of two of such floor panels provide a locking in a first direction perpendicular to the plane of the floor panels, as well as in a second direction perpendicular to the respective edges and parallel to the plane of the floor panels, wherein said coupling parts comprise a tongue having an upper and lower side and a groove, further wherein the groove is located between an upper lip having a lower side and a lower lip, the lower lip having an upper side and extending distally beyond the upper lip, and the coupling parts including locking portions effecting a locking in said second direction and being at least formed by contact portions including contact surfaces having upper and lower ends, which, in the coupled condition of two of such floor panels, contact and cooperate with each other, wherein one of said contact portions is situated in the upper side of the lower lip, such that said one contact portion is located beyond the upper lip and wherein said contact portions are situated such that the floor panels, in coupled condition, are urged with a tension force at least laterally towards each other, and wherein said coupling parts also comprise cooperating support portions on the lower side of the tongue and the upper side of the lower lip, which, in the coupled condition of the respective floor panels, are located distally beyond the upper lip, and engage and contact each other and cause a fixation in the relative positions of the contact surfaces of the contact portions relative to each other, while said contact surfaces of said contact portions cooperate under tension, whereby relative sliding between said contact surfaces is prevented when the panels undergo vertical or rotation forces tending to slightly move the surfaces relative to each other, and wherein the support portions, seen in cross-section, and according to a direction perpendicular to the coupled edges and in the plane of the floor panels, are situated adjacent one of said upper and lower ends.

* * * * *